US007080693B2

(12) United States Patent
Walker et al.

(10) Patent No.: US 7,080,693 B2
(45) Date of Patent: Jul. 25, 2006

(54) RETRIEVABLE PACKER ASSEMBLY, METHOD, AND SYSTEM WITH RELEASABLE BODY LOCK RING

(75) Inventors: Neil Walker, Aberdeen (GB); Robert Charles Smith, Alberdeen (GB); Bruce McAdam Norrie, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/684,926

(22) Filed: Oct. 14, 2003

(65) Prior Publication Data

US 2005/0077053 A1 Apr. 14, 2005

(51) Int. Cl.
*E21B 33/12* (2006.01)

(52) U.S. Cl. ..... 166/387; 166/187

(58) Field of Classification Search ..... 166/387, 166/118, 120, 187, 182
See application file for complete search history.

(56) References Cited

U.S. PATENT DOCUMENTS

| | | | | |
|---|---|---|---|---|
| 1,804,619 A | | 5/1931 | Humason | |
| 3,602,305 A | | 8/1971 | Kisling, III | 116/134 |
| 3,603,388 A | * | 9/1971 | Current et al. | 166/120 |
| 4,289,200 A | | 9/1981 | Fisher, Jr. | 166/120 |
| 4,526,229 A | * | 7/1985 | Dickerson | 166/120 |
| 4,573,537 A | | 3/1986 | Hirasuna et al. | 166/387 |
| 4,582,135 A | | 4/1986 | Akkerman | 166/134 |
| 5,069,280 A | | 12/1991 | McKee et al. | 166/278 |
| 5,311,938 A | | 5/1994 | Hendrickson et al. | 166/134 |
| 5,526,884 A | * | 6/1996 | Lembcke | 166/120 |
| 5,727,632 A | * | 3/1998 | Richards | 166/387 |
| 5,884,699 A | | 3/1999 | Mullen et al. | 166/134 |
| 5,941,306 A | | 8/1999 | Quinn | 166/120 |
| 6,629,563 B1 | * | 10/2003 | Doane | 166/120 |

* cited by examiner

*Primary Examiner*—Jennifer H. Gay
*Assistant Examiner*—Matthew J. Smith
(74) *Attorney, Agent, or Firm*—Madan, Mossman & Sriram, P.C.

(57) ABSTRACT

A releasable packer device and a method for selectively releasing a packer assembly from a set position in a wellbore. A packer assembly is described that incorporates a split body lock ring that is in ratcheting engagement with a central mandrel to secure the packer elements in a set position. In addition, there is a mechanical means for releasing the body lock ring from its locking position to an unlocked position. The body lock ring is released by radially expanding the ring by urging an axially-movable release sub with a releasing portion into contact with the body lock ring to unseat the ratcheting mechanism that retains the packer assembly in its set position.

23 Claims, 10 Drawing Sheets

RETRIEVABLE PACKER ASSEMBLY, METHOD, AND SYSTEM WITH RELEASABLE BODY LOCK RING

BACKGROUND OF THE INVENTION

1. Field of the Invention

The invention relates generally to releasable wellbore packers. In particular aspects, the invention relates to improved packer devices and methods for release of packer devices from a wellbore.

2. Description of the Related Art

Packers are set within a wellbore to form a fluid seal between the borehole wall and a tubing string. Non-retrievable, or permanent, packers are sometimes used where a permanent closure is desired. In order to remove a permanent packer, a milling tool is disposed into the wellbore above the packer and mill away the upper setting slips that hold the packer in its set position. This process is time consuming and requires an additional trip into the well. In other cases, retrievable packers are used, which allow the option to release the packer from its set position and removing it.

A standard technique for removing retrievable packers involves pulling upwardly to shear a shear ring or other shearable member. U.S. Pat. No. 4,688,641 issued to Knierieman, for example, discloses a well packer that is releasable by use of a jarring tool that shears a threaded connection, there by releasing the packer from its set position. Shear members of a predetermined load are often used where the upward loading on the packer can be limited during normal production and standard well conditions. However, this is not always the case, and an alternative arrangement is needed.

U.S. Pat. No. 3,990,510 describes a well anchor tool that uses a set of releasable collet fingers to set the packer element. A special retrieving tool, which is run into the wellbore separately, can engage the collet fingers and release them to unset the packer.

Other retrievable packer designs are known, but these suffer from similar drawbacks. Retrievable packers generally do not provide for a means of hydraulically releasing the packer assembly from the wellbore.

The present invention addresses the problems of the prior art.

SUMMARY OF THE INVENTION

The invention provides a releasable packer device and a method for releasing a packer from a set position in a wellbore. A packer assembly is described that incorporates a split body lock ring that is in ratcheting engagement with a central mandrel to secure the packer elements in a set position. In addition, there is a mechanical means for releasing the body lock ring from its locking position to an unlocked position. The body lock ring is released by radially expanding the ring by urging an axially-movable release sub with a releasing portion into contact with the body lock ring to unseat the ratcheting mechanism that retains the packer assembly in its set position.

In a first preferred embodiment, the releasing portion of the axially-moveable release sub comprises at least one, and preferably a plurality of, thin and elongated fingers that are shaped and sized slip between the ratcheted surface of the body lock ring and the ratcheted surface of the central mandrel, thereby breaking the ratchet engagement. In a second embodiment, the releasing portion of the release sub comprises a wedge-shaped projection that will be inserted into the split ring gap of the body lock ring to radially expand it, thereby causing the ratchet engagement of the body lock ring with the central mandrel to become unseated.

In operation, the packer assembly is set by moving a setting piston with respect to the central mandrel, thereby axially compressing the packer and slip elements of the packer assembly. A body lock ring provides a ratchet engagement that prevents unsetting of the packer and slip elements from occurring. Once the ratchet engagement of the body lock ring with the inner mandrel is broken, the setting piston will be released and permitted to move axially with respect to the central mandrel, and the packer elements will be unset from the wellbore wall. A further embodiment of the invention is described wherein a release sleeve, moveable by mechanical manipulation of a surface-run shifter tool, is used to unset the packer elements.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1A:
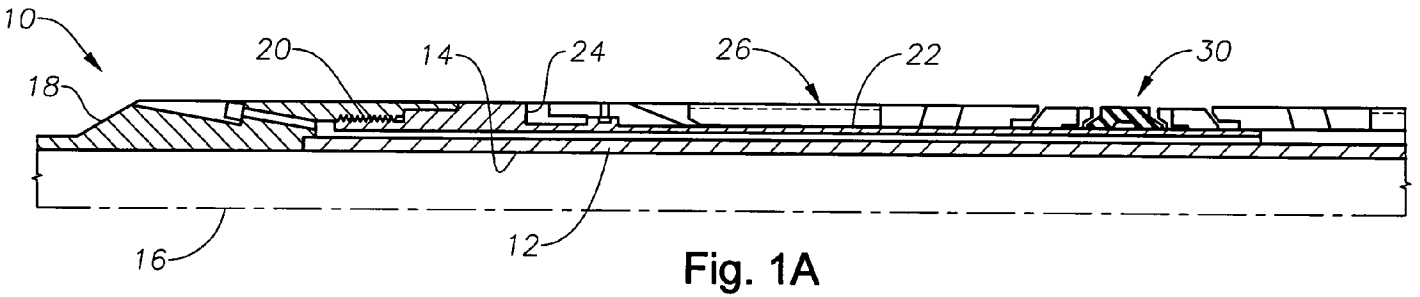
FIGS. 1A, 1B, and 1C present a partial side cross-sectional view of an exemplary releasable packer assembly constructed in accordance with the present invention.
Figure 1B:
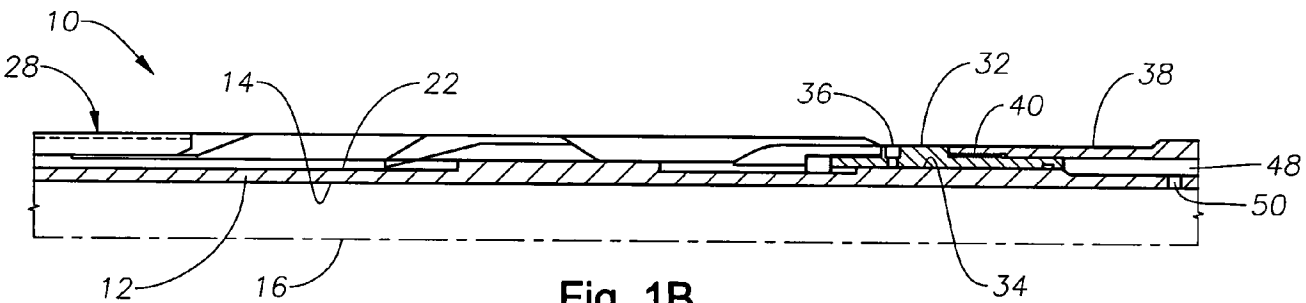
Figure 1C:
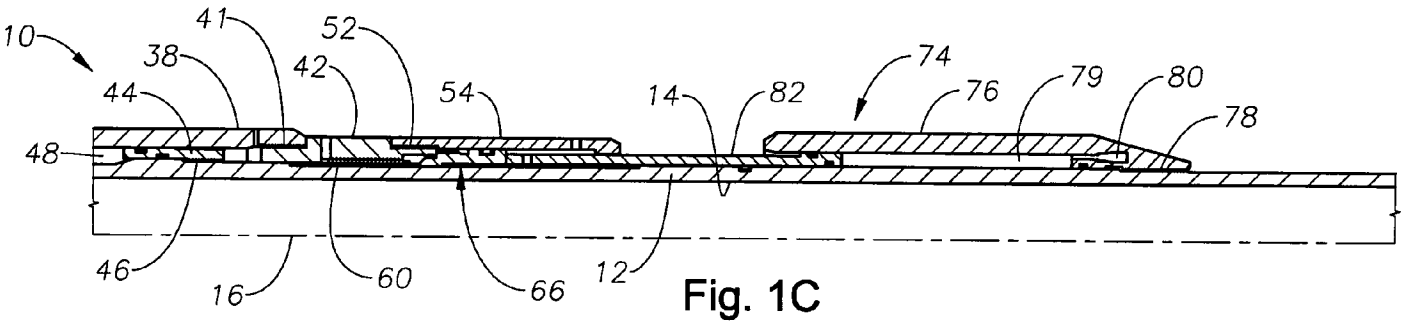

FIGS. 1A, 1B, and 1C, as well as 2A and 2B, illustrate an exemplary hydraulically set, retrievable packer assembly 10, constructed in accordance with the present invention. The packer assembly 10 includes a central mandrel 12 that defines an axial flowbore 14 along its length. The central axis of the flowbore 14 is illustrated at 16. At the upper end of the packer assembly 10 is an upper sub 18, which is secured by threaded connection 20 to the central mandrel 12. The central mandrel 12 presents a radially reduced outer surface area 22 upon which compressible packer and slip elements are disposed. The central mandrel 12 also presents a downwardly-facing stop shoulder 24 proximate its upper end. A pair of slip-type packer elements 26, 28 and an elastomeric packer element 30 surround the central mandrel 12 upon the radially reduced outer surface area 22. The slip and packer elements 26, 28, and 30 are shown generally, but are of the type that is urged into a set position by axial compression. The slip-type packer elements 26, 28 are also known merely as "slips," which are metallic toothed elements that are selectively urged radially outwardly to permit the teeth of the slip to engage the wall of a wellbore in a biting relation. The elastomeric packer element 30 is of the type that, when compressed axially, extrudes radially to form a fluid seal within a wellbore. A number of such elements are available commercially, and their structure and operation is, of course, well known to those of skill in the art.

At the lower end of the slip element 28 is a setting piston 32 that is disposed in an axially moveable relation upon an outer radial surface 34 of the central mandrel 12. Initially, the setting piston 32 is secured against axial movement with respect to the central mandrel 12 by a shear pin 36. The shear pin 36 is a frangible member that is designed to break away, or fail, upon encountering a predetermined level of shear stress. A bridge sleeve 38 is secured to the lower end of the setting piston 32 by a threaded connection 40. The lower end of the bridge sleeve 38 is secured by a second threaded connection 41 to a body lock ring housing 42. An annular ring 44 radially surrounds the central mandrel 12 within the bridge sleeve 38 and is threaded at 46 to securely affix the annular ring 44 to the central mandrel 12. An upper hydraulic fluid chamber 48 is defined radially between the central mandrel 12 and the bridge sleeve 38. The upper end of the upper hydraulic fluid chamber 48 is defined by the setting piston 32, while the lower end of the upper hydraulic fluid chamber 48 is defined by the annular ring 44. A fluid communication port 50 (see FIG. 1B) is disposed through the central mandrel 12 to permit fluid communication between the flowbore 14 and the upper hydraulic chamber 48.

Figure 2A:
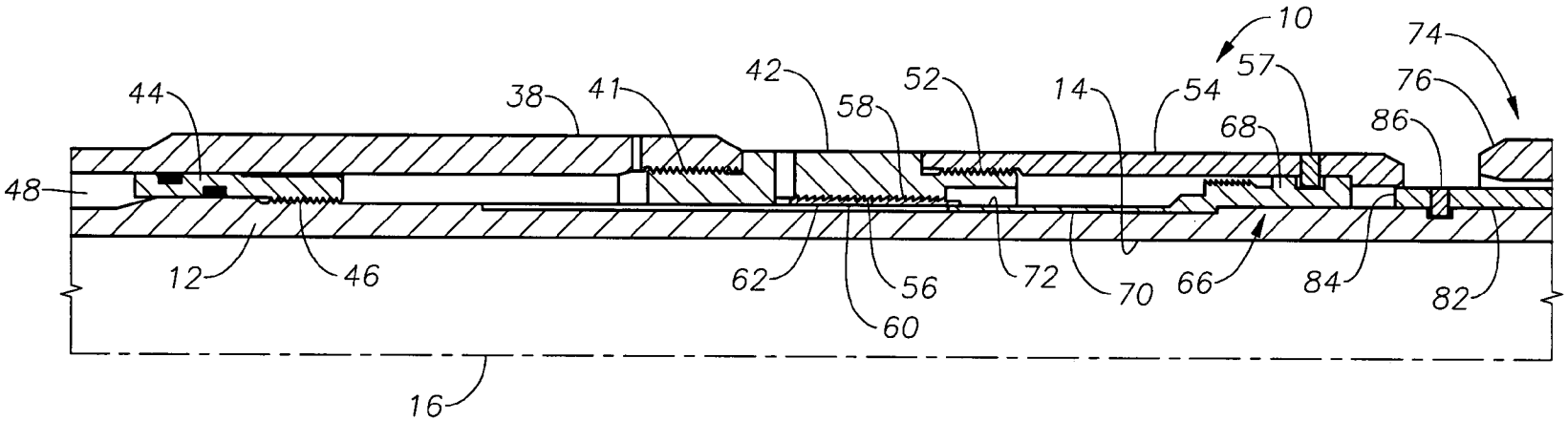
FIGS. 2A and 2B are an enlarged side, cross-sectional view of an exemplary release mechanism for the releasable packer assembly constructed in accordance with the present invention, and in an unset, running-ill position.
Figure 2B:
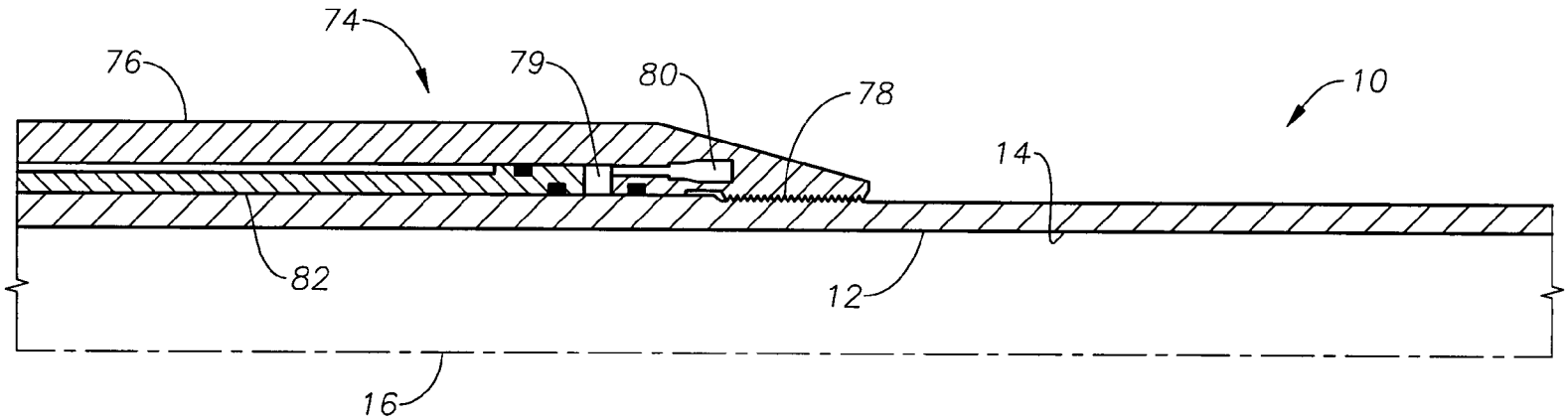
Figure 13:
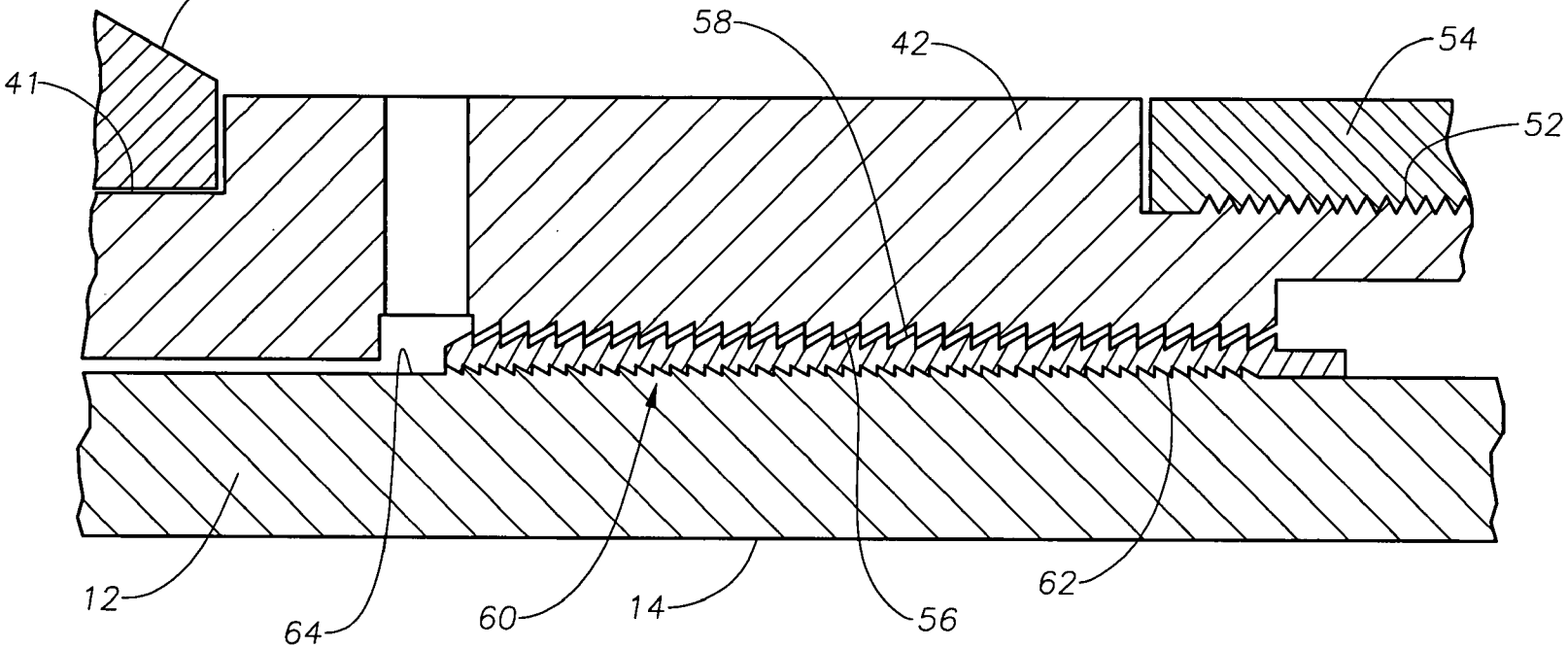
FIG. 13 is an enlarged detail view of the body lock ring and surrounding components.

The lower end of the body lock ring housing 42 has a threaded connection 52 to an annular release sub housing 54. The inner radial surface of the body lock ring housing 42 also presents a toothed ratchet surface 56 (see FIG. 2A) that is in locking engagement with a complimentary toothed outer ratchet surface 58 on body lock ring 60. The body lock ring 60 is a split ring, or "C"-ring that radially surrounds the central mandrel 12 and has a split 61, which is depicted in FIG. 9B. The structure of the body lock ring 60 and associated ratchet surfaces and engagements is better understood with reference to the enlarged detail provided by FIG. 13. The body lock ring 60 includes a radially inner ratchet surface 62 that is less coarse (i.e., or finer pitch) than the outer ratchet surface 58. The inner ratchet surface 62 engages the outer radial surface 64 of the central mandrel 12. The outer radial surface 64 of the central mandrel 12 may be smooth, roughened, or contain a ratchet surface that is complimentary to the inner ratchet surface 62 of the body lock ring 60.

Figure 6:
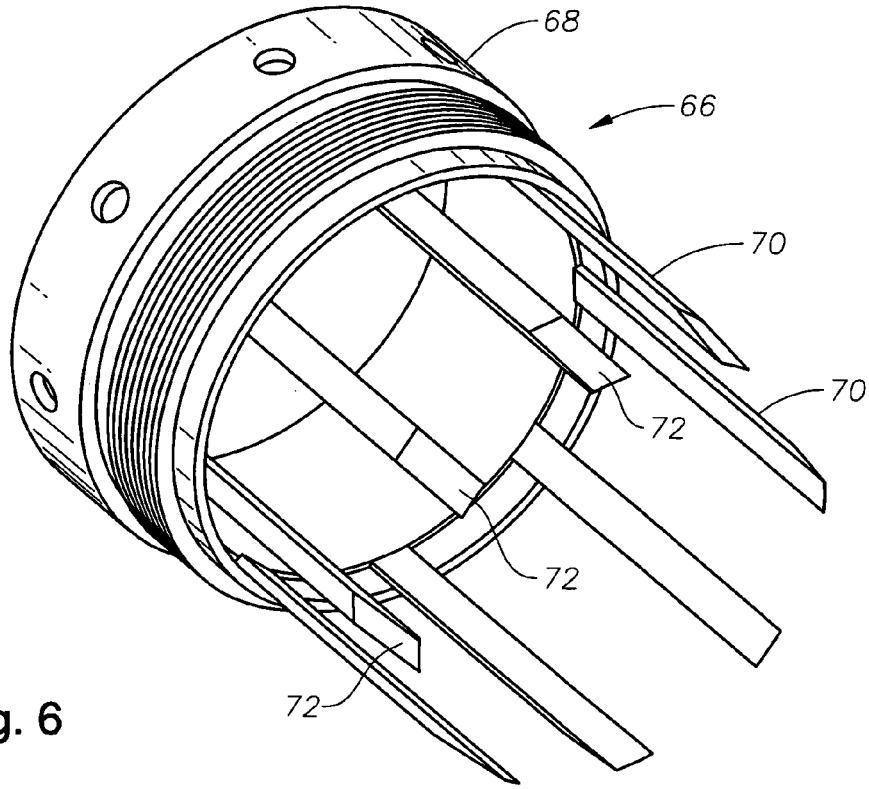
FIG. 6 is an isometric view of an exemplary release sub.
Figure 7:
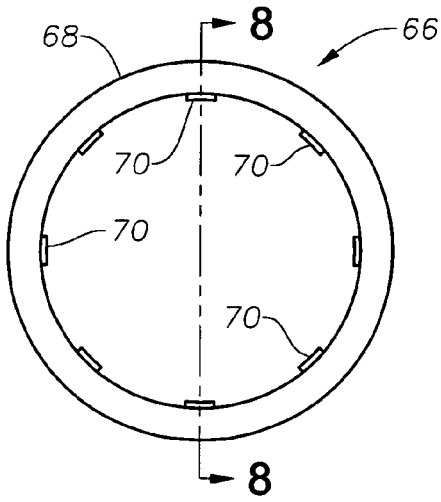
FIG. 7 is an end view of the exemplary release sub shown in FIG. 6.
Figure 8:
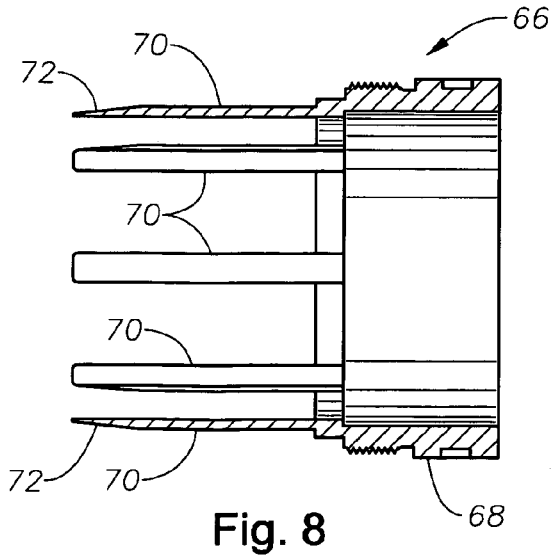
FIG. 8 is a cross-sectional view taken along lines 8–8 in FIG. 7.

Referring again to FIGS. 1C, 2A, and 3A, it can be seen that the release sub housing 54 radially surrounds a release sub 66. A plurality of frangible shear pins 57 (one shown) interconnects the release sub housing 54 to the release sub 66. The release sub 66 is shown apart from other components in FIGS. 6, 7, and 8, where it can be seen that the sub 66 includes a solid annular body 68 with a plurality of axially extending releasing portions 70. The releasing portions 70 are fingers, each of which having a tapered end portion 72, which is shaped and sized to slip between the body lock ring 60 and the central mandrel 12. In the embodiment shown in FIGS. 6, 7, and 8, there are eight such releasing portions 70 that are located in spaced relation from one another about the inner circumference of the body 68. However, there may be more or fewer than eight releasing portions 70.

A release sleeve assembly 74 is shown in FIG. 1C, as well as FIGS. 2A–2B and 3A–3B. The release sleeve assembly 74 includes an annular release sleeve housing 76 that radially surrounds the central mandrel 12. The lower end of the release sleeve housing 76 is secured to the central mandrel 12 by a threaded connection 78. A lower hydraulic chamber 79 is defined radially within the piston housing 76. A hydraulic fluid inlet port 80 for the chamber 79 is contained within the lower end of the release sleeve housing 76. Release sleeve 82 is retained radially within the release sleeve housing 76. The release sleeve 82 presents an upper ram end 84 and is initially secured to the central mandrel 12 by a frangible shear pin 86.

Figure 9A:
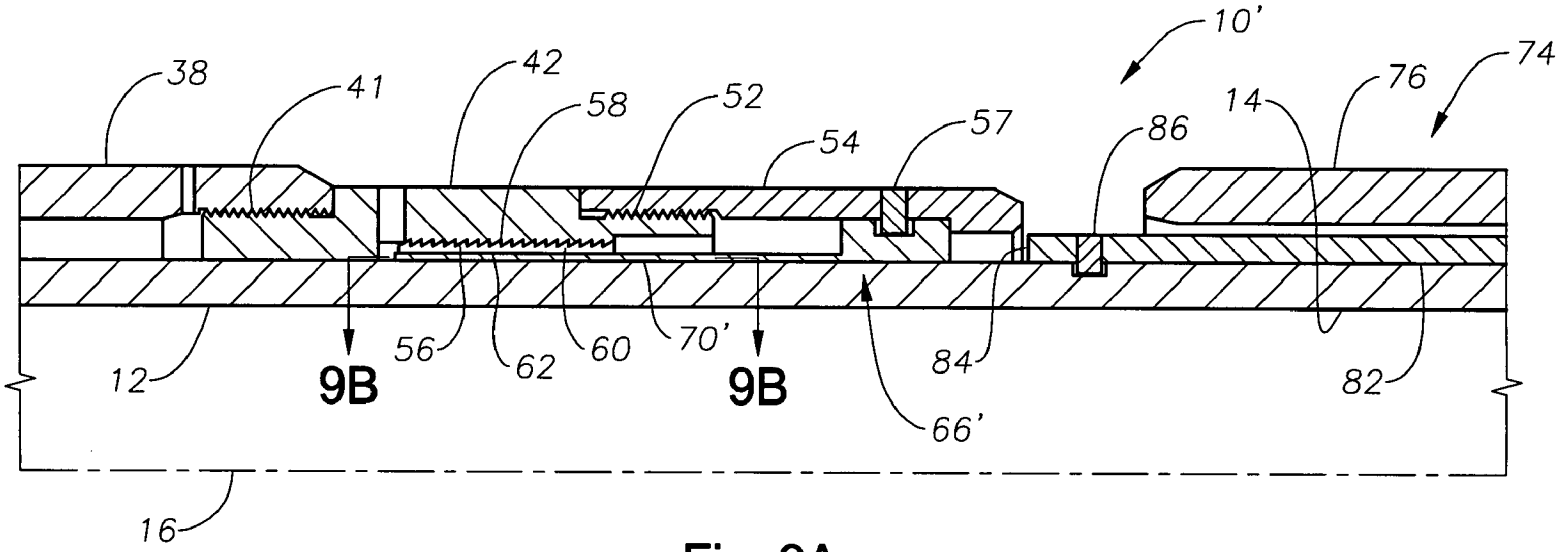
FIG. 9A is an enlarged side, cross-sectional view of an alternative embodiment for a releasable packer assembly constructed in accordance with the present invention.
Figure 9B:
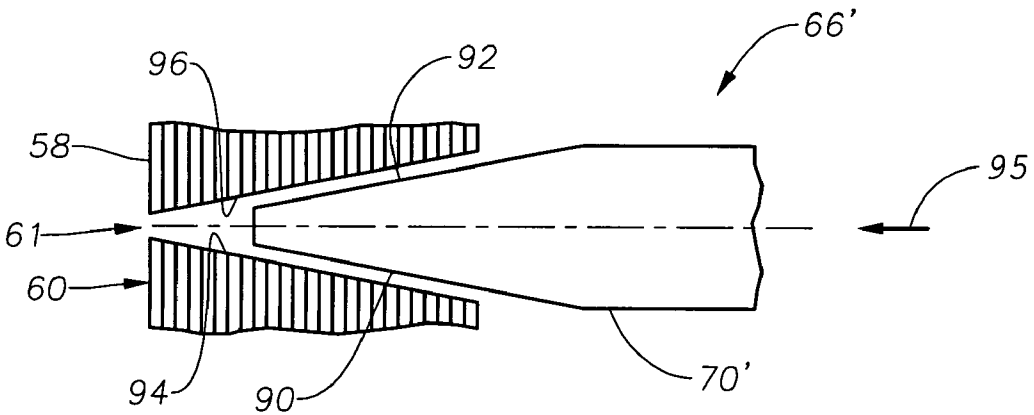
FIG. 9B is a cutaway view taken along lines 9B—9B in FIG. 9A.
Figure 10:
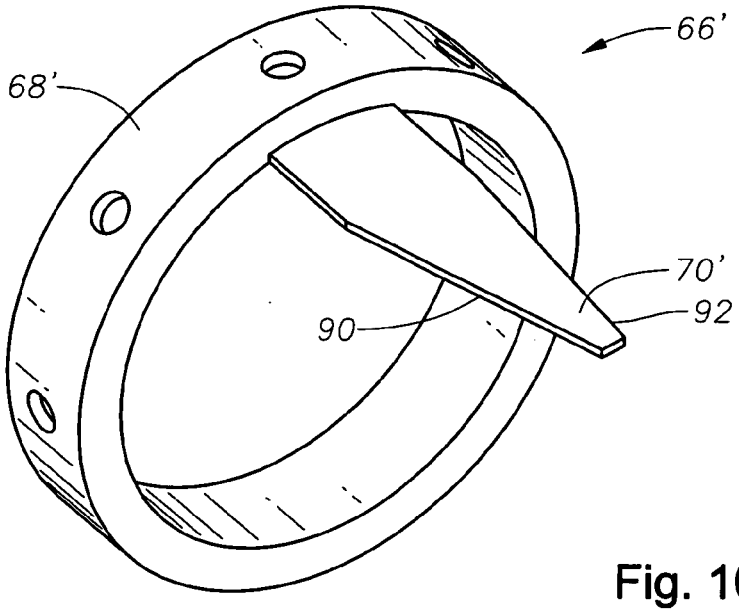
FIG. 10 is an isometric view of an alternative exemplary release sub.
Figure 11:
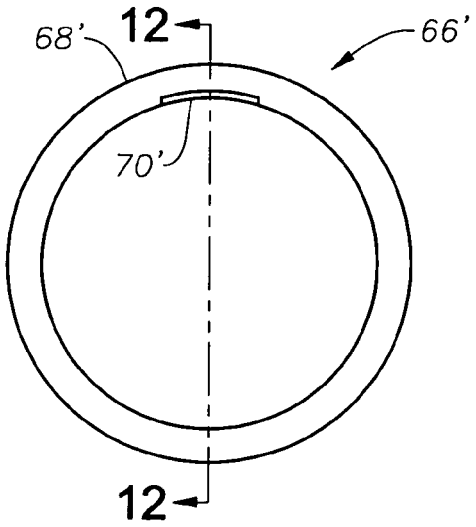
FIG. 11 is an end view of the release sub shown in FIG. 10.
Figure 12:
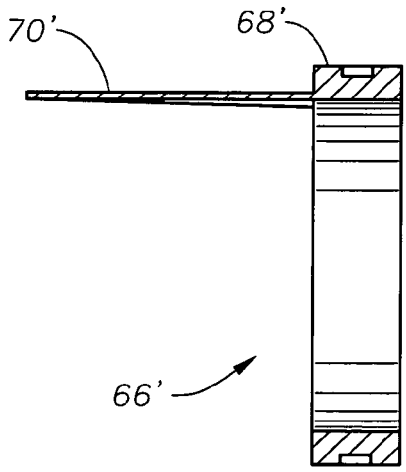
FIG. 12 is a cross-sectional cutaway taken along lines 12—12 in FIG. 11.

FIGS. 9A and 9B depict an alternative construction for a packer assembly 10' that features an alternate exemplary release sub mechanism. The exemplary packer assembly 10' is identical to the exemplary packer assembly 10 in all respects, except where noted. A release sub 66' is used in place of the release sub 66 described previously. The alternative release sub 66' is illustrated apart from other components in FIGS. 10, 11, and 12. The alternative release sub 66' features an annular body 68' with an axially-extending wedge-shaped expander as the releasing portion 70'. FIG. 9B illustrates the releasing portion 70' proximate the body lock ring 60. As illustrated in FIGS. 9B and 10, the releasing portion 70' features converging side edge surfaces 90, 92, which will adjoin diverging side edge surfaces 94, 96 of the split 61 on the body lock ring 60. As the release sub 66' is moved axially upwardly (in the direction of arrow 95 in FIG. 9B), the converging side surfaces 90, 92 will urge the split 61 to open wider, thereby increasing the diameter of the body lock ring 60.

Figure 3A:
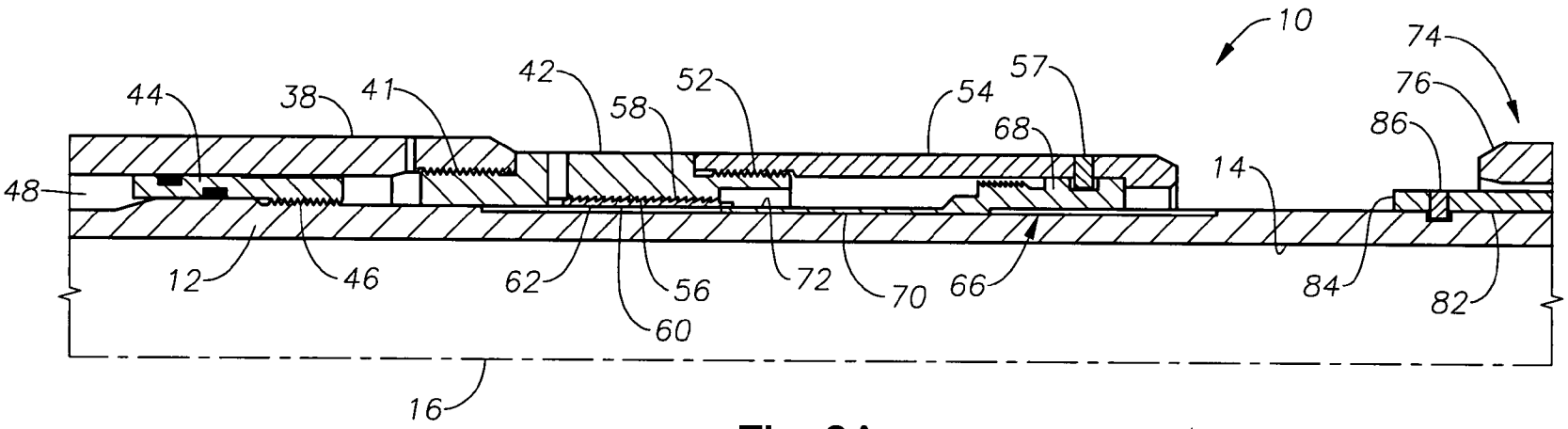
FIGS. 3A and 3B are an enlarged side, cross-sectional view of an exemplary release mechanism for the releasable packer assembly constructed in accordance with the present invention, wherein the packer has been placed into a set position.
Figure 3B:
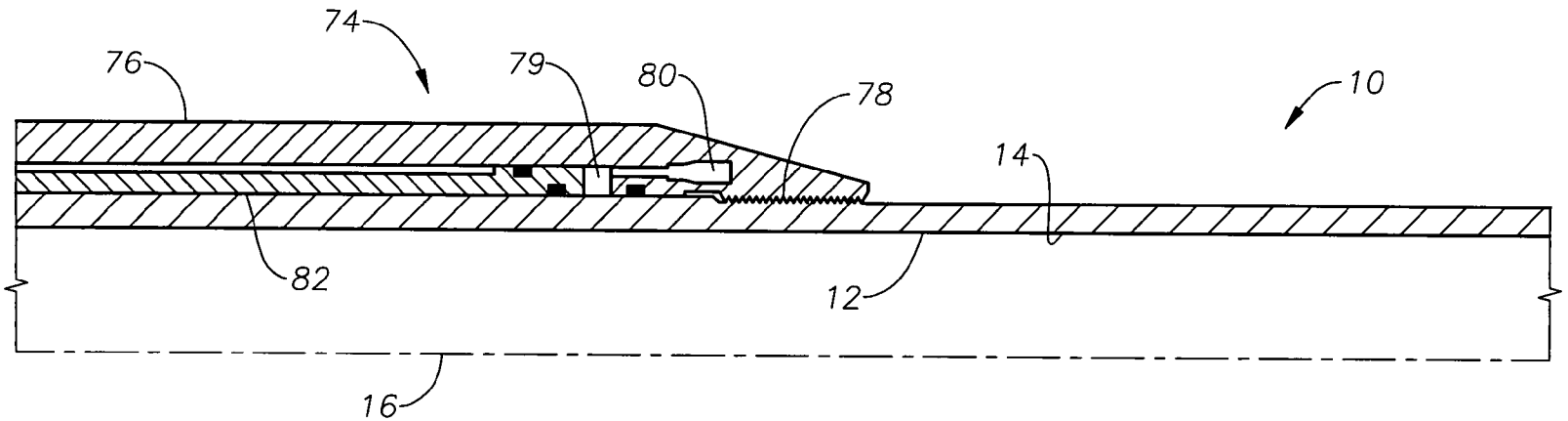

In general, as is well known, the packer assembly 10 is disposed within a wellbore upon a production tubing string so that an annulus is defined between the packer assembly 10 and the wall of the surrounding wellbore. The packer assembly 10 may be releasably set against the borehole wall, as will be described. Initially, the packer assembly 10 is run into the wellbore in the position shown in FIGS. 2A and 2B. A plug or ball (not shown) of a type known in the art, is dropped into the flowbore 14 and becomes seated upon a ball seat (not shown) within the production string at some point below the packer assembly 10, thus closing off the flowbore 14 to fluid flow. Fluid pressure within the flowbore 14 is increased at the surface of the well, and pressurized fluid enters the upper hydraulic chamber 48 via the fluid communication port 50 in the central mandrel 12. Upon application of a sufficiently high amount of fluid pressure within chamber 48, the shear pin 36 will break, and the setting piston 32 will be moved upwardly with respect to the central mandrel 12. Due to the interconnection of the bridge sleeve 38 to the setting piston 32 and body lock ring housing 42, the body lock ring housing 42 and body lock ring 60 are moved upwardly with respect to the central mandrel as well. The ratchet engagement of the inner ratchet surface 62 with the outer surface 64 of the central mandrel 12 secures the body lock ring 60 in an axially upper position, as shown in FIGS. 3A and 3B. At this point, the packer element 30 and slip elements 26, 28 are set within the wellbore. Fluid pressure within the flowbore 14 and upper hydraulic chamber 48 may be reduced at this point, since the packer 30 and slip elements 26, 28 will be retained in their set positions by the ratcheted engagement of the body lock ring 60 with the central mandrel 12.

When it is desired to unset the packer element 30 and slip elements 26, 28, hydraulic fluid is flowed through the inlet port 80 and into the lower hydraulic chamber 79. This is typically accomplished using a wireline-run device known as a punch tool, or punch communication tool. The punch tool (not shown) is run into the flowbore 14 on wireline and seated into a punch nipple (also not shown) that is incorporated into the tubing string, in a manner that is known in the art. The punch tool includes a radially outwardly-directed penetrator, and jarring force on the wireline will cause the penetrator to move radially outwardly and penetrate the central mandrel 12 proximate the inlet port 80. When this occurs, a flowpath is created into the lower hydraulic chamber 79, allowing hydraulic fluid to be flowed from the surface into the chamber 79 via the punch tool. Other means known in the art for transmitting hydraulic fluid from the surface into the chamber 79 may also be used to pressurize the chamber 79.

Figure 4A:
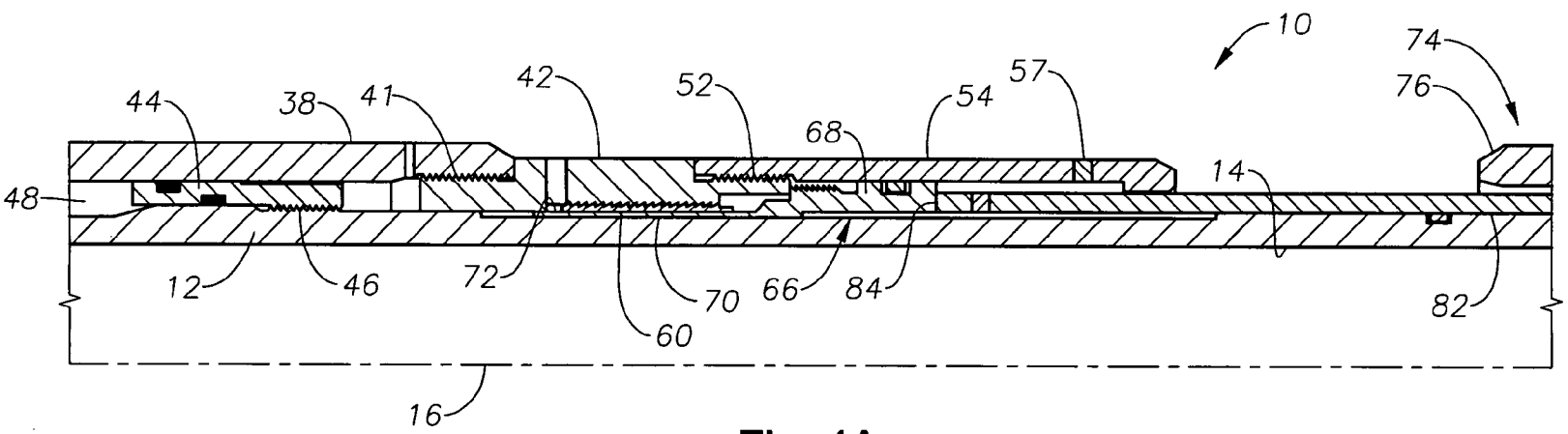
FIGS. 4A and 4B are an enlarged side, cross-sectional view of an exemplary release mechanism for the releasable packer assembly constructed in accordance with the present invention, during activation of the release mechanism.
Figure 4B:
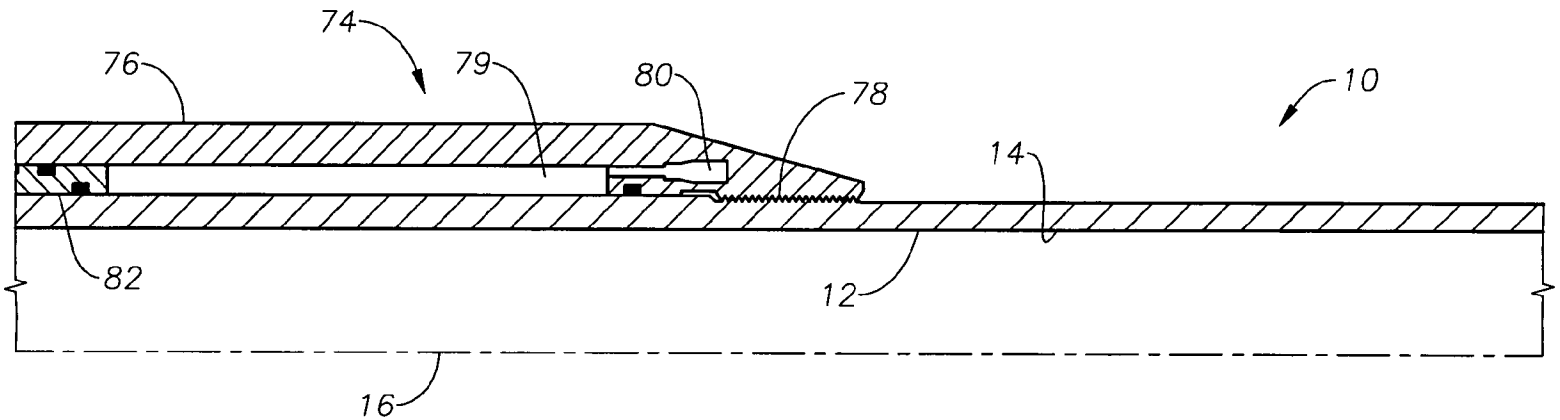

As the lower hydraulic chamber 79 is pressurized, the release sleeve assembly 74 is actuated. The shear pin 86 is broken, and the release sleeve 82 is moved axially upwardly with respect to the central mandrel 12. The ram end 84 of the release sleeve 82 then abuts the lower end of the release sub 66 (or 66'). The shear pin 57 that secures the release sub 66 (or 66') to the release sub housing 54 is then broken, and the release sub 66 (or 66') is moved axially upwardly with respect to the central mandrel 12. The release portions 70 (or 70') of the release sub 66 (or 66') will then cause the ratchet connection between the body lock ring 60 and the central mandrel 12 to be disengaged. Ramped surfaces 72 of release portions 70 will slide beneath the inner surface 62 of the body lock ring 60 and thereby release the ratcheted engagement with the outer surface 64 of the central mandrel 12. The body lock ring 60 will also be expanded radially, permitting it to slip axially with respect to the central mandrel 12. If, alternatively, the release sub 66' is used, the side edge surfaces 90, 92 of the releasing portion 70' will contact and engage the side edge surfaces 94, 96 of the body lock ring 60 and, in the manner of a wedge, will expand the gap 61 of the body lock ring 60. The body lock ring 60 will be expanded radially, and the ratcheted engagement between the inner surface 62 of the body lock ring 60 with the outer surface 64 of the central mandrel will be disengaged. In both cases, the body lock ring 60 will be released from engagement with the central mandrel 12, as depicted in FIG. 4A (for release sub 66).

Figure 5A:
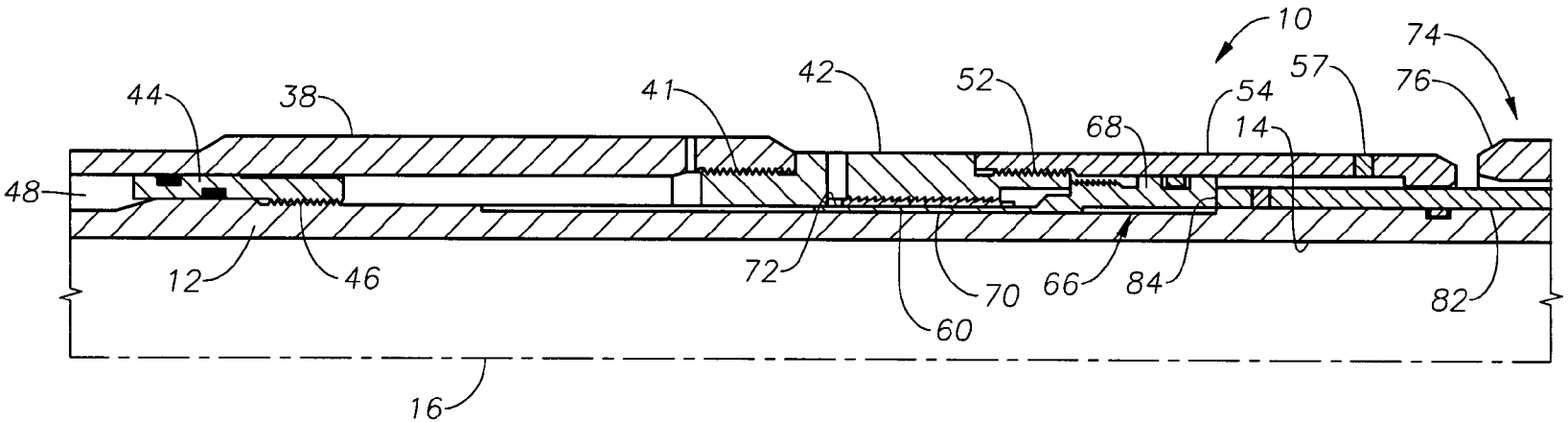
FIGS. 5A and 5B are an enlarged side, cross-sectional view of an exemplary release mechanism for the releasable packer assembly constructed in accordance with the present invention, following release of the packer elements from their set position.
Figure 5B:
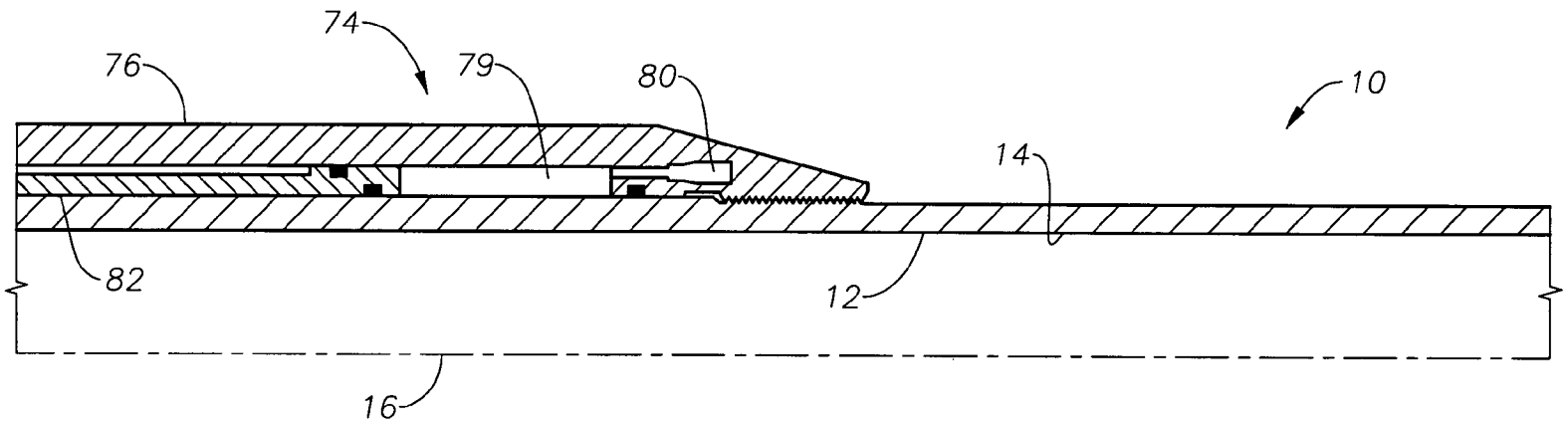

Following mechanical release of the body lock ring 60 from the central mandrel 12, the packer 30 and slip elements 26, 28 are then released from their set position by reducing fluid pressure within the lower hydraulic chamber 79. This is accomplished from the surface of the well. When fluid pressure within the lower hydraulic chamber 79 is reduced, the components that are axially compressing the picker 30 and slip elements 26, 28 are moved axially downwardly with respect to the central mandrel 12. The setting piston 32, bridge sleeve 38, body lock ring housing 42, body lock ring 60, release sub housing 54, release sub 66 (or 66'), and release sleeve 82 are all shifted downwardly to the position illustrated in FIGS. 5A and 5B. The tubing string may then be withdrawn from the wellbore to remove the packer assembly 10.

Figure 14A:
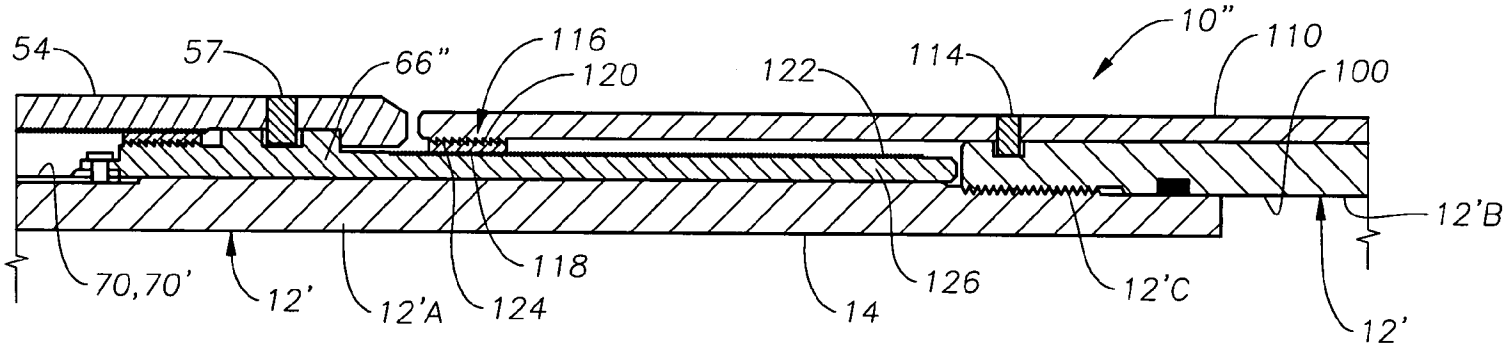
FIGS. 14A–14B are a side, cross-sectional view of a further alternative exemplary release mechanism in accordance with the present invention, prior to release of the packer assembly.
Figure 14B:
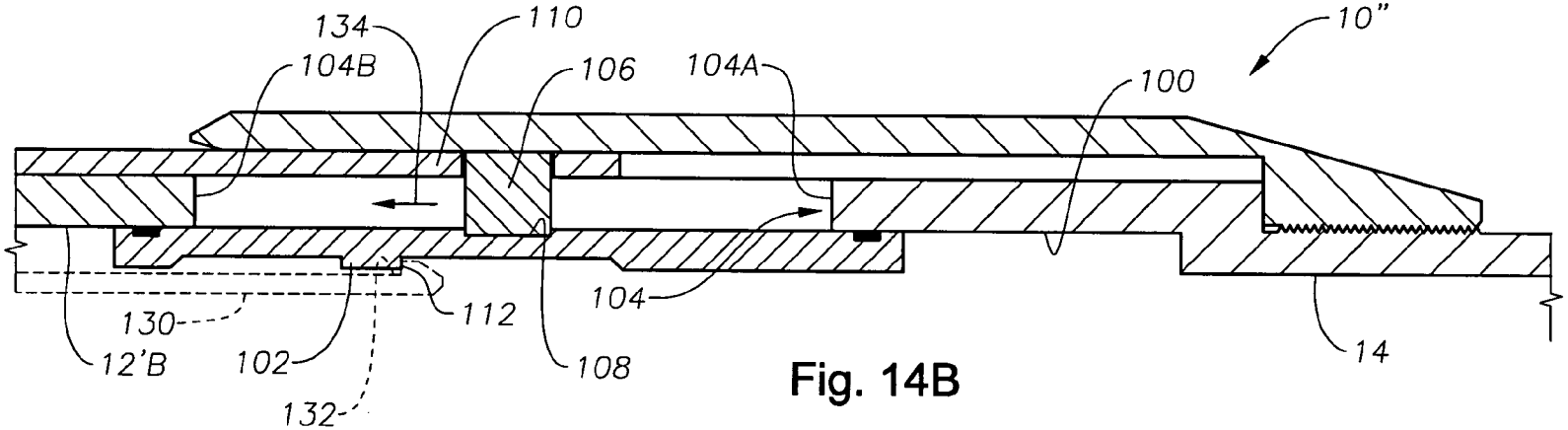

Turning now to FIGS. 14A and 14B, there is illustrated the lower portions of a packer assembly 10" having an alternative mechanism for releasing the body lock ring 60. Except where indicated otherwise, the structure and function of the packer assembly 10" is the same as that of packer assemblies 10 and 10' described earlier. In the packer assembly 10", however, release sleeve 82 is moved upwardly to release the body lock ring 60 by mechanical, rather than hydraulic actuation. The inner mandrel 12' is made up of two tubular portions 12'A and 12'B, which are interconnected by threading 12° C. The inner mandrel 12' contains a radially enlarged sleeve housing 100 within which annular shifting sleeve 102 is reciprocally disposed. The mandrel 12' also has at least one axially elongated slot 104 disposed therein. A plate 106 is disposed through the slot 104 and is fixedly secured to the outer radial surface 108 of the shifting sleeve 102 as well as to sliding release sleeve 110, which lies radially outside of the mandrel 12'. It is noted that the plate 106 is capable of axial movement within the slot 104 between a lower end 104A and an upper end 104B. The shifting sleeve 102 presents a radially interior engagement profile 112. The release sleeve 110 is secured by a shear pin 114 to the inner mandrel 12', and the upper end of the release sleeve 110 is in fixedly engaged contact with the release sub 66" via a locking ring 116 that has inner and outer toothed engagement surfaces 118, 120, respectively. The inner toothed engagement surface 118 fixedly interlocks with a complimentary outer toothed surface 122 on the release sub 66". The outer toothed engagement surface 120 interlocks with a complimentary toothed surface 124 on the release sleeve 110. As a result of these interlocking engagements, upward movement of the release sleeve 110 will result in upward movement of the release sub 66".

In this embodiment, the release sub 66" is slightly modified from the designs previously described. As illustrated in FIG. 14A, the release sub 66" includes an extended tubular lower extension 126, which carries the toothed surface 124. The release sub 66" may carry either of the engagement portions 70 or 70' described earlier in order to release the body lock ring 66.

In order to release the body lock ring 60 from engagement with the inner mandrel 12', a shifting tool, shown schematically at 130 in FIG. 14B, is lowered into the flowbore 14. The shifting tool 130 has an engagement profile 132 that is complimentary to the engagement profile 112 of the shifting sleeve 102. Typically, the engagement profile 132 of the shifting tool 130 is formed into a colleted end of the shifting tool 130 so that the two profiles 132, 112 may snap together into an interlocking engagement when the shifting tool 130 is brought into contact with the shifting sleeve 102. Once the two profiles 132, 112 are brought into engagement, the shifting tool 130 can be moved upwardly, thereby sliding the shifting sleeve 102 upwardly as well. As the shifting sleeve 102 is moved upwardly, the plate 106 moves upwardly within the slot 14, in the direction of arrow 134. Due to the fixed connection of the plate 106 with the release sleeve 110, the release sleeve 110 is also moved upwardly, along with the release sub 66", which, in the manners described previously, will engage and release the body lock ring 60.

It can be seen that the invention provides a novel method of releasably setting and then unsetting a packer assembly within a wellbore. The invention also provides a novel packer assembly and system.

Those of skill in the art will recognize that numerous modifications and changes may be made to the exemplary designs and embodiments described herein and that the invention is limited only by the claims that follow and any equivalents thereof.

What is claimed is:

1. A releasable packer assembly comprising:

a central mandrel defining a flowbore within;

a compressible packer element surrounding the central mandrel to be set against a wall of a wellbore;

a hydraulic setting assembly for compressing the packer element into a set position against a wellbore wall;

a locking member that selectively engages the central mandrel for securing the packer element in a set position and having a gap formed therein; and a release assembly for selectively releasing the locking member from engagement with the central mandrel by expanding the gap.

2. The releasable packer assembly of claim 1 wherein:

the locking member comprises a body lock ring having a body providing an annular circumference with the gap in the circumference and a radially inner ratchet surface for ratcheting engagement with the central mandrel; and the release assembly comprises a release sub having a release portion for contacting the locking member and releasing the ratcheting engagement with the central mandrel.

3. The releasable packer assembly of claim 2 wherein the release portion comprises an extending finger having a ramped portion that is disposed between the body lock ring and the central mandrel to release the ratcheting engagement.

4. The releasable packer assembly of claim 3 wherein there are a plurality of said fingers disposed in a spaced relation about the release sub.

5. The releasable packer assembly of claim 2 wherein the release portion comprises an expander member that is disposed within the gap in the circumference of the body lock ring to expand the body lock ring radially to release the ratcheting engagement.

6. The releasable packer assembly of claim 5 wherein the expander member further comprises a pair of converging side edge surfaces that are disposed within the gap to expand the gap upon movement of the release sub.

7. The releasable packer assembly of claim 1 further comprising a release sleeve for actuating the release sub, the release sleeve being moveable with respect to the central mandrel and having a ram end for engaging the release sub and urging it toward the body lock ring.

8. The releasable packer assembly of claim 7 wherein the release sleeve is moveable in response to hydraulic pressure.

9. The releasable packer assembly of claim 7 wherein the release sleeve is moveable by mechanically shifting a shifter sleeve to engage and slide the release sleeve.

10. A system for releasably setting a packer assembly against a wall of a weilbore comprising:

a packer element that is compressible to be set against a wall of a wellbore;

a locking assembly having a split-ring locking member to secure the packer element in a set position via a ratcheting engagement, the locking member having a gap formed therein;

an axially movable release sleeve;

an axially movable release sub that is actuated by the release sleeve, the release sub having a releasing portion to contact the locking member and release it from ratcheting engagement by expanding the gap.

11. The system of claim 10 wherein the release sub comprises an annular ring body and an extending releasing portion to release the ratcheting engagement.

12. The system of claim 11 wherein the releasing portion comprises a finger that is disposed beneath the locking member to disengage the ratcheting engagement.

13. The system of claim 12 wherein the finger presents a ramped portion to slide beneath the locking member.

14. The system of claim 11 wherein the releasing portion comprises an expander member that is disposed within the gap of the locking member to expand the locking member radially to release the ratcheting engagement.

15. The system of claim 14 wherein the expander member further comprises a pair of converging side edge surfaces that are disposed within the gap to expand the gap upon movement of the release sub.

16. The system of claim 10 further comprising a shifter sleeve in mechanical communication with the release sleeve for movement of the release sleeve, the shifter sleeve having an engagement profile for interlocking engagement with a shifter tool.

17. A method of selectively setting and releasing a packer assembly from a set position in a wellbore comprising the steps of:

compressing a packer element to be set against a wellbore wall;

engaging a locking member to retain the packer element in its set position the locking member having a gap formed therein;

releasing the locking member by urging a release sub into contact with the locking member to release engagement of the locking member by expanding the gap; and moving the locking member to release the packer element from its set position.

18. The method of claim 17 wherein the step of releasing the locking member further comprises disposing a releasing portion of the release sub beneath the locking member.

19. The method of claim 17 wherein the step of releasing the locking member further comprises disposing a releasing portion of the release sub into a the gap in the locking member.

20. The method of claim 17 wherein the step of releasing the locking member further comprises moving a release sleeve into abutting contact with the release sub to urge the release sub into contact with the locking member.

21. The method of claim 18 wherein the release sleeve is moved by increase of hydraulic pressure within a hydraulic fluid chamber.

22. The method of claim 18 wherein the release sleeve is moved by mechanical actuation of a shifter tool.

23. The method of claim 17 wherein the step of moving the locking member to release the packer element from its set position further comprises decreasing hydraulic pressure within a hydraulic fluid chamber.

* * * * *